US005595255A

United States Patent [19]

Huffstutler

[11] Patent Number: 5,595,255

[45] Date of Patent: Jan. 21, 1997

[54] ROTARY CONE DRILL BIT WITH IMPROVED SUPPORT ARMS

[75] Inventor: Alan D. Huffstutler, Grand Prairie, Tex.

[73] Assignee: Dresser Industries, Inc., Dallas, Tex.

[21] Appl. No.: 287,441

[22] Filed: Aug. 8, 1994

[51] Int. Cl.[6] ..... F21B 10/08; E21B 10/12

[52] U.S. Cl. ..... 175/331; 175/339

[58] Field of Search ..... 175/331, 337, 175/338, 339, 374, 375, 340

[56] References Cited

U.S. PATENT DOCUMENTS

| | | | |
|---|---|---|---|
| Re. 19,339 | 10/1934 | Vertson | 145/347 |
| Re. 32,495 | 9/1987 | Coates | 175/339 |
| D. 265,205 | 6/1982 | Munson | D15/139 |
| 1,906,427 | 5/1933 | Sievers et al. | 175/292 |
| 1,908,049 | 5/1933 | Reed | 175/313 |
| 2,030,723 | 2/1936 | Scott et al. | 175/362 |
| 2,047,112 | 7/1936 | Reed | 175/363 |
| 2,063,012 | 12/1936 | Catland | 175/357 |
| 2,064,273 | 12/1936 | Scott | 175/342 |
| 2,065,743 | 12/1936 | Reed | 175/366 |
| 2,068,375 | 1/1937 | Catland | 175/357 |
| 2,124,521 | 7/1938 | Williams et al. | 175/366 |
| 2,151,347 | 3/1939 | Fisher | 175/363 |
| 2,176,358 | 10/1939 | Pearce . | |
| 2,260,487 | 10/1941 | Scott | 175/340 |
| 2,318,370 | 5/1943 | Burch | 175/366 |
| 2,634,105 | 4/1953 | Gruner . | |
| 2,648,526 | 8/1953 | Lanchester | 175/340 |
| 2,782,005 | 2/1957 | Appleton | 175/339 |
| 2,950,090 | 8/1960 | Swart . | |
| 3,130,801 | 4/1964 | Schumacher, Jr. . | |
| 3,442,342 | 5/1969 | McElya et al. | 175/374 |
| 3,628,616 | 12/1971 | Neilson | 175/375 |
| 3,800,891 | 4/1974 | White et al. | 175/374 |
| 3,825,083 | 7/1974 | Flarity et al. | 175/394 |

(List continued on next page.)

FOREIGN PATENT DOCUMENTS

| | | |
|---|---|---|
| 936382 U | 12/1955 | Germany . |
| 533719 | 10/1976 | U.S.S.R. . |
| 1305295 | 4/1987 | U.S.S.R. . |
| 1467157 | 3/1989 | U.S.S.R. . |

OTHER PUBLICATIONS

International Search Report, International Application No. PCT/US95/10115, dated Jan. 4, 1996.

U.S. Patent Application No. 29/043782 filed Sep. 12, 1995, entitled Rotary Cone Drill Bit.

U.S. Patent Application 08/422140 filed Apr. 13, 1995 and entitled Rotary Drill Bit and Method for Manufacture and Rebuild.

U.S. Patent Application 08/478455 filed Jun. 6, 1995 and entitled Rotary Cone Drill Bit Modular Arm.

U.S. patent application Ser. No. 08/287,457 filed Aug. 8, 1994 and entitled Rock Bit With Enhanced Fluid Return Area.

(List continued on next page.)

*Primary Examiner*—David J. Bagnell
*Attorney, Agent, or Firm*—Baker & Botts, L.L.P.

[57] ABSTRACT

A rotary cone drill bit for forming a borehole having a bit body with an upper end portion adapted for connection to a drill string. The drill bit rotates around a central axis of the body. A number of support arms are preferably extend from the bit body. The support arms may either be formed as an integral part of the bit body or attached to the exterior of the bit body in pockets sized to receive the associated support arm. Each support arm has a lower portion with an inside surface and a spindle connected thereto and an outer shirttail surface. Each spindle projects generally downwardly and inwardly with respect to its associated support arm. A number of cutter cone assemblies equal to the number of support arms are mounted respectively on the spindles. A throat relief area is provided on the lower portion of each support arm adjacent to the associated spindle to increase fluid flow between the support arm and the respective cutter cone assembly.

19 Claims, 5 Drawing Sheets

U.S. PATENT DOCUMENTS

| | | | |
|---|---|---|---|
| 3,850,256 | 11/1974 | McQueen | 175/228 |
| 4,054,772 | 10/1977 | Lichte | 219/121 |
| 4,056,153 | 11/1977 | Miglierini | 175/376 |
| 4,067,406 | 1/1978 | Garner et al. | 175/341 |
| 4,098,448 | 7/1978 | Sciaky et al. | 228/102 |
| 4,145,094 | 3/1979 | Verzirian | 384/96 |
| 4,209,124 | 6/1980 | Baur et al. | 228/182 |
| 4,256,194 | 3/1981 | Varel | 175/375 |
| 4,280,571 | 7/1981 | Fuller | 175/337 |
| 4,333,364 | 6/1982 | Varel | 76/108.2 |
| 4,350,060 | 9/1982 | Vezirian | 76/108.2 |
| 4,352,400 | 10/1982 | Grappendorf et al. | 175/405.1 |
| 4,369,849 | 1/1983 | Parrish | 175/340 |
| 4,417,629 | 11/1983 | Wallace | 175/356 |
| 4,421,184 | 12/1983 | Mullins | 175/337 |
| 4,552,232 | 11/1985 | Frear | 175/337 |
| 4,623,027 | 11/1986 | Vezirian | 175/340 |
| 4,624,329 | 11/1986 | Evans et al. | 175/331 X |
| 4,630,693 | 12/1986 | Goodfellow | 175/366 |
| 4,635,728 | 1/1987 | Harrington | 166/341 |
| 4,711,143 | 12/1987 | Loukanis et al. . | |
| 4,727,943 | 3/1988 | Wood | 175/229 |
| 4,750,573 | 6/1988 | Wynn | 175/359 |
| 4,765,205 | 8/1988 | Higdon . | |
| 4,813,502 | 3/1989 | Dysart | 175/339 X |
| 4,817,852 | 4/1989 | Hill | 228/114 |
| 4,848,491 | 7/1989 | Burridge et al. | 175/329 |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett | 175/57 |
| 5,145,016 | 9/1992 | Estes | 175/331 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,281,260 | 1/1994 | Kumar et al. | 75/240 |
| 5,289,889 | 3/1994 | Gearhart | 175/325.5 |
| 5,351,768 | 10/1994 | Scott et al. | 175/374 |
| 5,439,067 | 8/1995 | Huffstutler | 175/339 |
| 5,439,068 | 8/1995 | Huffstutler et al. | 175/339 |

OTHER PUBLICATIONS

U.S. patent application Ser. No. 08/287,446 filed Aug. 8, 1994 and entitled Modular Rotary Drill Bit.

U.S. patent application Ser. No. 08/287,390 filed Aug. 8, 1994 and entitled Rotary Drill Bit and Method For Manufacture and Rebuild.

U.S. Des. patent application Ser. No. 29/033,599 filed Jan. 17, 1995 and entitled Rotary Conde Drill Bit.

U.S. Des. patent application Ser. No. 29/033,630 filed Jan. 17, 1995 and entitled Support Arm and Rotary Cone for Modular Drill Bit.

U.S. patent application Ser. No. 08/351,019 filed Dec. 7, 1994 and entitled Rotary Cone Drill Bit and Method for Enhanced Lifting of Fluids and Cuttings.

U.S. patent application Ser. No. 08/350,910 filed Dec. 7, 1994 and entitled Rotary Cone Drill Bit With Angled Ramps.

Security/Dresser "Security Oilfield Catalog" Rock bits, Diamond Products, Drilling Tools, *Security Means Technology.* (Undated).

"State of the Science in Rock Bit techn." by Carlos Fernandez, SPACEBIT. Aug. 1991.

22
44
42
26
24
40
28
126
20
52
86
84
48
60
46
70
160
70
88
100
102
104
104
102
100

FIG. 5
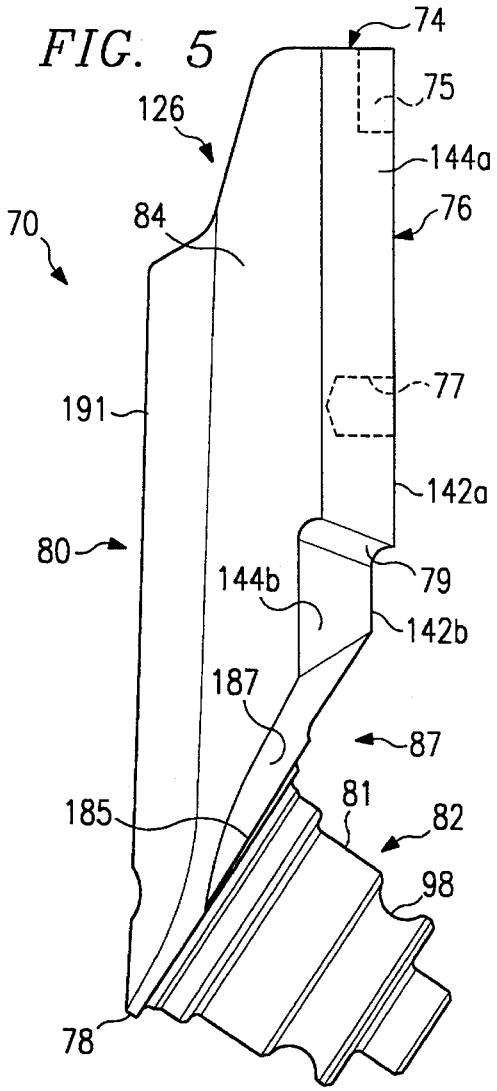
FIG. 8
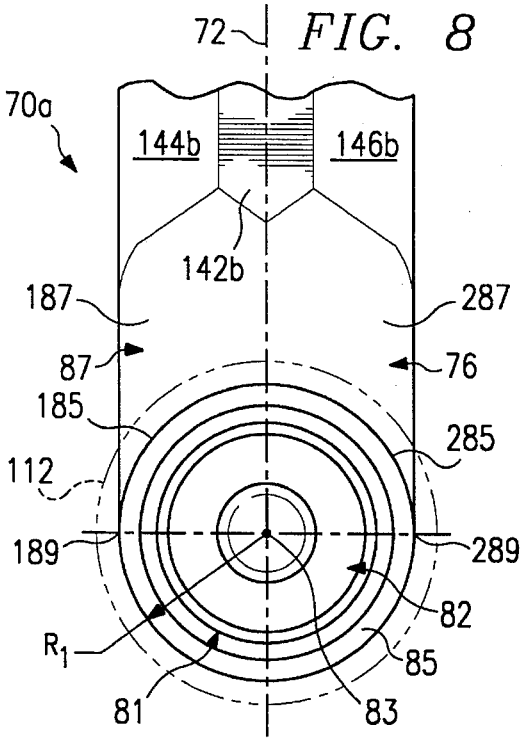
FIG. 7
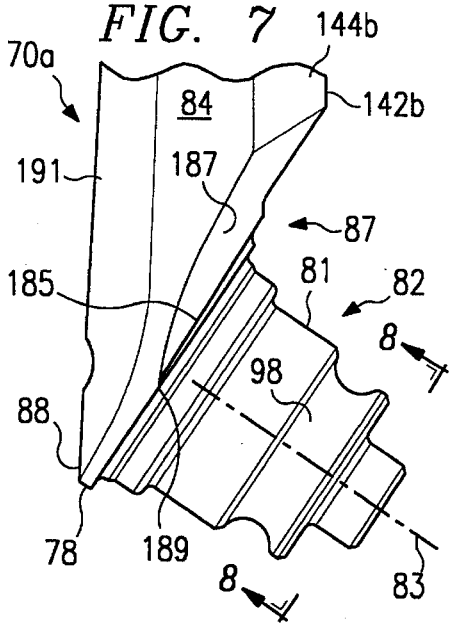
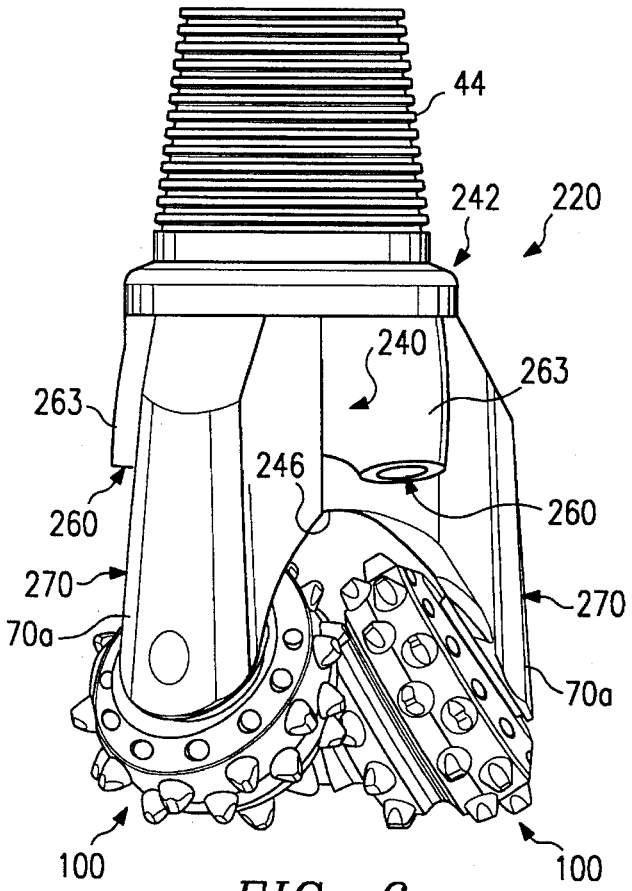
FIG. 6

ROTARY CONE DRILL BIT WITH IMPROVED SUPPORT ARMS

RELATED APPLICATION

This application is related to U.S. Pat. No. 5,439,068 issued Aug. 8, 1995, entitled *Modular Rotary Drill Bit,* (Attorney's Docket 060220.0170); U.S. Pat. No. 5,439,067 issued Aug. 8, 1995 entitled *Rock Bit With Enhanced Fluid Return Area* (Attorney's Docket 060220.0169); copending application entitled *Rotary Drill Bit and Method for Manufacture and Rebuild,* Ser. No. 08/287,390 filed Aug. 8, 1994 (Attorney's Docket 060220.0172); copending application entitled *Rotary Cone Drill Bit,* Ser. No. 29/033,599 filed Jan. 17, 1995 (Attorney's Docket 060220.0173), now abandoned; copending application entitled *Support Arm and Rotary Cone for Modular Drill Bit,* Ser. No. 29/033,630 filed Jan. 17, 1995 (Attorney's Docket 060220.0174); copending application entitled *Rotary Cone Drill Bit and Method for Enhanced Lifting of Fluids and Cuttings,* Ser. No. 08/351,019, filed Dec. 7, 1994 (Attorney's Docket 060220.0178); and copending application entitled *Rotary Cone Drill Bit With Angled Ramps,* Ser. No. 08/350,910, filed Dec. 7, 1994 (Attorney's Docket 060220.0179).

TECHNICAL FIELD OF THE INVENTION

This invention relates in general to rotary drill bits used in drilling a borehole in the earth and in particular to a drill bit having a bit body, support arms and a spindle extending from each support arm for mounting a cutter cone assembly thereon.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper end adapted for connection to a drill string. A plurality of support arms, typically three, depend from the lower end portion of the bit body with each arm having a spindle protruding radially inward and downward with respect to a projected rotational axis of the bit body.

Conventional roller cone bits are typically constructed in three segments. The segments may be positioned together longitudinally with a welding groove between each segment. The segments may then be welded with each other using conventional techniques to form the bit body. Each segment also includes an associated support arm extending from the bit body. An enlarged cavity or passageway is typically formed in the bit body to receive drilling fluids from the drill string. U.S. Pat. No. 4,054,772 entitled, *Positioning System for Rock Bit Welding* shows a method and apparatus for constructing a three cone rotary rock bit from three individual segments. U.S. Pat. No. 4,054,772 is incorporated by reference for all purposes within this application.

A cutter cone is generally mounted on each spindle and supported rotatably on bearings acting between the spindle and the inside of a spindle receiving cavity in the cutter cone. One or more nozzles may be formed on the underside of the bit body adjacent to the support arms. The nozzles are typically positioned to direct drilling fluid passing downwardly from the drill string through the bit body toward the bottom of the borehole being formed. Drilling fluid is generally provided by the drill string to perform several functions including washing away material removed from the bottom of the borehole, cleaning the cutter cones, and carrying the cuttings radially outward and then upward within the annulus defined between the exterior of the bit body and the wall of the borehole. U.S. Pat. No. 4,056,153 entitled, *Rotary Rock Bit with Multiple Row Coverage for Very Hard Formations* and U.S. Pat. No. 4,280,571 entitled, *Rock Bit* show examples of conventional roller cone bits with cutter cone assemblies mounted on a spindle projecting from a support arm. U.S. Pat. No. 4,056,153 and U.S. Pat. No. 4,280,571 are incorporated by reference for all purposes within this application.

While drilling with such rotary or rock bits, cuttings and other types of debris may collect in downhole locations with restricted fluid flow. Examples of such locations with restricted fluid flow include the lower portion of the bit body adjacent to the respective support arms, the annulus area between the exterior of the bit body and the adjacent wall of the borehole. Other areas of restricted fluid flow may include the backface of the respective cutter cones and the wall of the borehole. As a result of collecting such debris, the area available for fluid flow is reduced even further resulting in an increase in fluid velocity through such areas and erosion of the adjacent metal components. As this erosion progresses, vital components such as bearings and seals may be exposed to drilling fluids and well debris which can lead to premature failure of the associated rock bit.

SUMMARY OF THE INVENTION

In accordance with the present invention, the disadvantages and problems associated with previous rock bits and rotary cone drill bits have been substantially reduced or eliminated. One aspect of the present invention includes a support arm and cutter cone assembly which provide enhanced fluid flow around the exterior of an associated rotary drill bit during drilling operations for removal of cuttings and other debris from the bottom of a borehole to the well surface. The lower portion of the support arm adjacent to the associated cutter cone assembly preferably includes one or more relief surfaces (sometimes referred to as a "throat relief area") which eliminate stagnation of cuttings and/or drilling fluids between the cutter cone assembly and its associated support arm. The relief surfaces formed on the support arm promote movement of drilling fluid with entrained cuttings and any other debris outwardly from the cutter cone assembly towards the wall of the borehole and upward through the annulus formed between the wall of the borehole and the exterior of an associated drill string.

Another aspect of the present invention includes providing a rotary drill bit having a one-piece or unitary bit body with a number of support arms spaced from each other on the exterior of the bit body. The lower portion of each support arm preferably includes a spindle for rotatably mounting a cutter cone assembly thereon. Adjacent to the spindle, a relief area may be formed on the inside surface of the respective support arm to improve fluid flow with respect to the support arm and its associated cutter cone assembly. For some applications the width of the support arm adjacent to its spindle is preferably equal to twice the distance from the center line of the spindle to the edge of a shirttail surface formed on the exterior of the associated support arm. The combination of throat relief area and uniform shirttail, dimensions results in improved fluid flow and minimizes the abrasive wear of machined surfaces formed on the associated cutter cone assembly, support arm and spindle.

A further aspect of the present invention includes providing a rotary drill bit having three segments which may be welded together to form an integrated bit body with three support arms incorporating one embodiment of the invention. The support arms are formed as an integral part of the bit body extending therefrom and spaced with respect to each other. The lower portion of each support arm preferably includes a spindle for rotatably mounting a cutter cone assembly thereon. Adjacent to the spindle, a throat relief area may be formed on the inside surface of the respective support arm to improve fluid flow with respect to the support arm and its associated cutter cone assembly. For some applications the width of the support arm adjacent to the spindle is preferably equal to twice the distance from the center line of the spindle to the edge of a shirttail surface formed on the exterior of the associated support arm. The combination of throat relief area and uniform shirttail dimensions results in improved fluid flow and minimizes abrasive wear of machined surfaces formed on the associated cutter cone assembly, support arm and spindle.

Still another aspect of the present invention includes a support arm and cutter cone assembly for a rotary drill bit having superior erosion protection. The support arm may be formed as an integral part of the associated bit body or the support arm may be attached to a one-piece bit body. The lower portion of the support arm preferably includes an inside surface with a spindle attached thereto, a shirttail surface, a bottom edge, and an exterior surface. The shirttail surface is further defined by a first radius extending from the center line or axis of the spindle to the bottom edge of the associated support arm. For one application, the width of the support arm is approximately equal to twice the radius from the center line of the spindle to the bottom edge of the support arm. The cutter cone assembly preferably includes a chamber with an opening to receive the spindle. A boss may be formed on the inside surface of the support arm with the spindle projecting therefrom. A machined surface, sometimes referred to as "the last machined surface" (LMS) is preferably formed on the boss adjacent to the spindle. The width of the lower portion of the support arm is selected to be equal to twice the radial distance from the center line of the spindle to the edge of the boss or last machined surface. The shirttail portion of the support arm is defined by the distance from the exterior surface of the spindle to the edge of the boss or last machined surface. The portion of the support arm adjacent to the spindle may sometimes be referred to as the throat relief area. Substantial portions of the throat relief area are preferably removed to increase fluid flow with respect to the cutter cone assembly mounted on the spindle and the adjacent inside surface of the support arm.

Important technical advantages of the present invention include providing a support arm and cutter cone assembly in which the length to width ratio of the support arm results in a slim design. For one application the lower portion of the support arm has a uniform width which eliminates projections (sometimes referred to as ears) which are typically present on the shirttail portion of previous support arm/cutter cone assemblies. Also, the present invention allows forming a shirttail portion on the exterior of the support arm with one or more tapered surfaces to promote flow of fluids with entrained cuttings between the exterior of the support arm and the wall of a borehole.

BRIEF DESCRIPTION OF THE DRAWINGS

For a more complete understanding of the present invention, and the advantages thereof, reference is now made to the following descriptions taken in conjunction with the accompanying drawings, in which:

FIG. 5 is a drawing in elevation of the support arm shown in FIG. 4;

FIG. 6 is an isometric drawing of another rotary cone drill bit having an integrated bit body and support arms incorporating an embodiment of the present invention;

FIG. 7 is a drawing in elevation with portions broken away showing the lower portion of a support arm which may be used with either the rotary cone drill bit of FIG. 2 or FIG. 6 and having enhanced fluid flow areas formed in accordance with one aspect of the present invention adjacent to an associated spindle;

FIG. 8 is a drawing taken along line 8—8 of FIG. 7; and

DETAILED DESCRIPTION OF THE INVENTION

Figure 1:
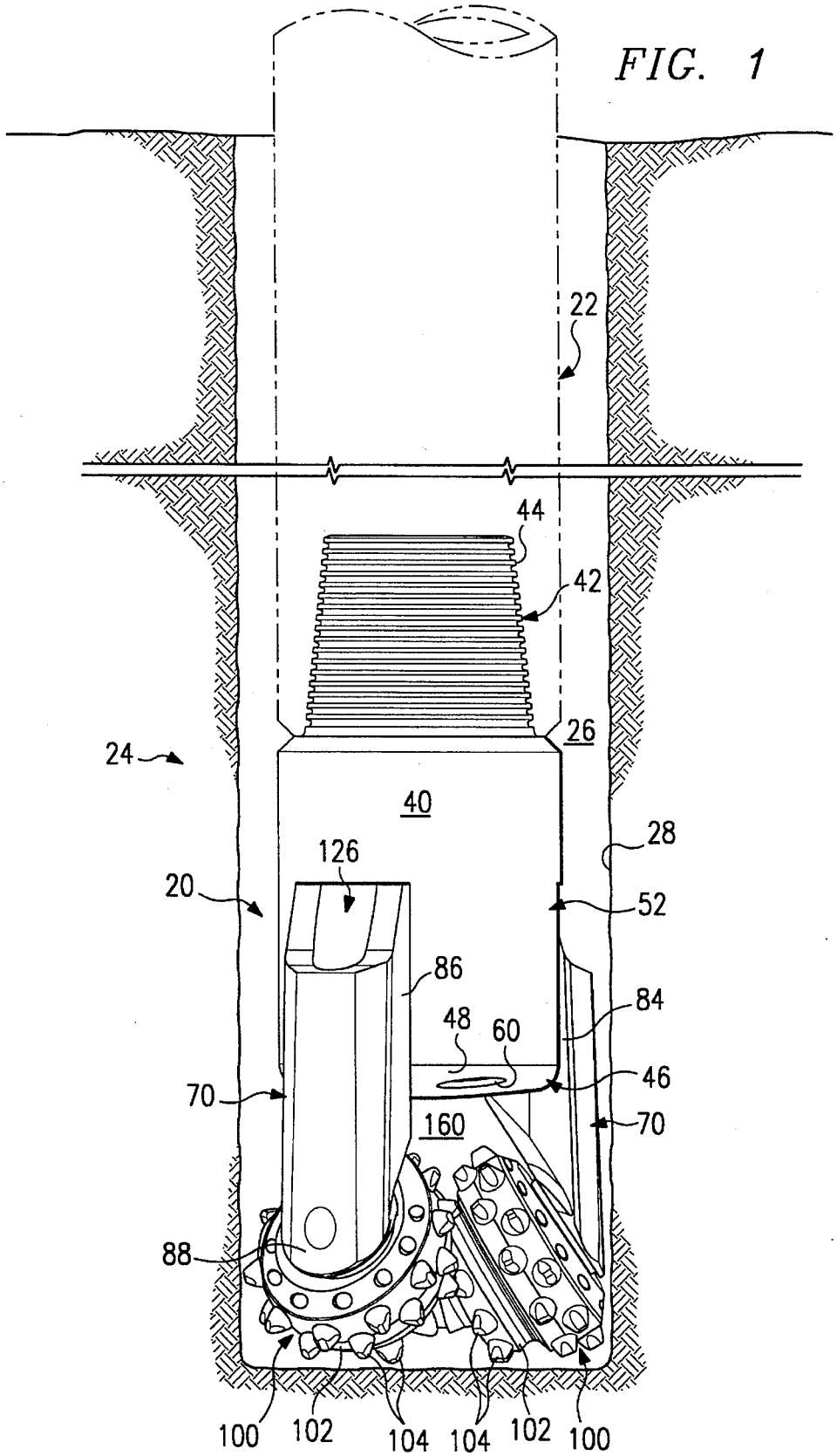
FIG. 1 is a schematic drawing in elevation and section with portions broken away showing a rotary cone drill bit, incorporating features of the present invention, attached to one end of a drill string disposed in a well bore.

The preferred embodiments of the present invention and its advantages are best understood by referring to FIGS. 1–13 of the drawings, like numerals being used for like and corresponding parts of the various drawings.

For purposes of illustration, the present invention is shown embodied in rotary cone drill bits 20 and 220 of the type used in drilling a borehole in the earth. Rotary cone drill bits 20 and 220 may sometimes be referred to as a "rotary drill bit" or "rock bit." Rotary cone drill bits 20 and 220 preferably include threaded connection or pin 44 for use in attaching the respective drill bit 20 and 220 with drill string 22. Threaded connection 44 and the corresponding threaded connection (not shown) associated with drill string 22 are designed to allow rotation of drill bits 20 and 220 in response to rotation of drill string 22 at the well surface.

In FIG. 1, drill bit 20 is shown attached to drill string 22 and disposed in borehole 24. Annulus 26 is formed between the exterior of drill string 22 and the interior or wall 28 of borehole 24. In addition to rotating drill bit 20, drill string 22 is often used to provide a conduit for communicating drilling fluids and other fluids from the well surface to drill bit 20 at the bottom of borehole 24. Such drilling fluids may be directed to flow from drill string 22 to various nozzles 60 provided in drill bit 20. Cuttings formed by drill bit 20 and any other debris at the bottom of borehole 24 will mix with the drilling fluids exiting from nozzles 60 and return to the well surface via annulus 26.

For rotary cone drill bit 20 cutting action or drilling action occurs as cutter cone assemblies 100 are rolled around the bottom of borehole 24 by rotation of drill string 22. The resulting inside diameter of borehole 24 defined by wall 28 corresponds approximately with the combined outside diameter or gauge diameter of cutter cone assemblies 100. Cutter cone assemblies 100 cooperate with each other to form wall 28 of borehole 24 in response to rotation of drill bit 20 Cutter cone assemblies 100 may sometimes be referred to as "rotary cone cutters" or, "roller cone cutters".

Figure 2:
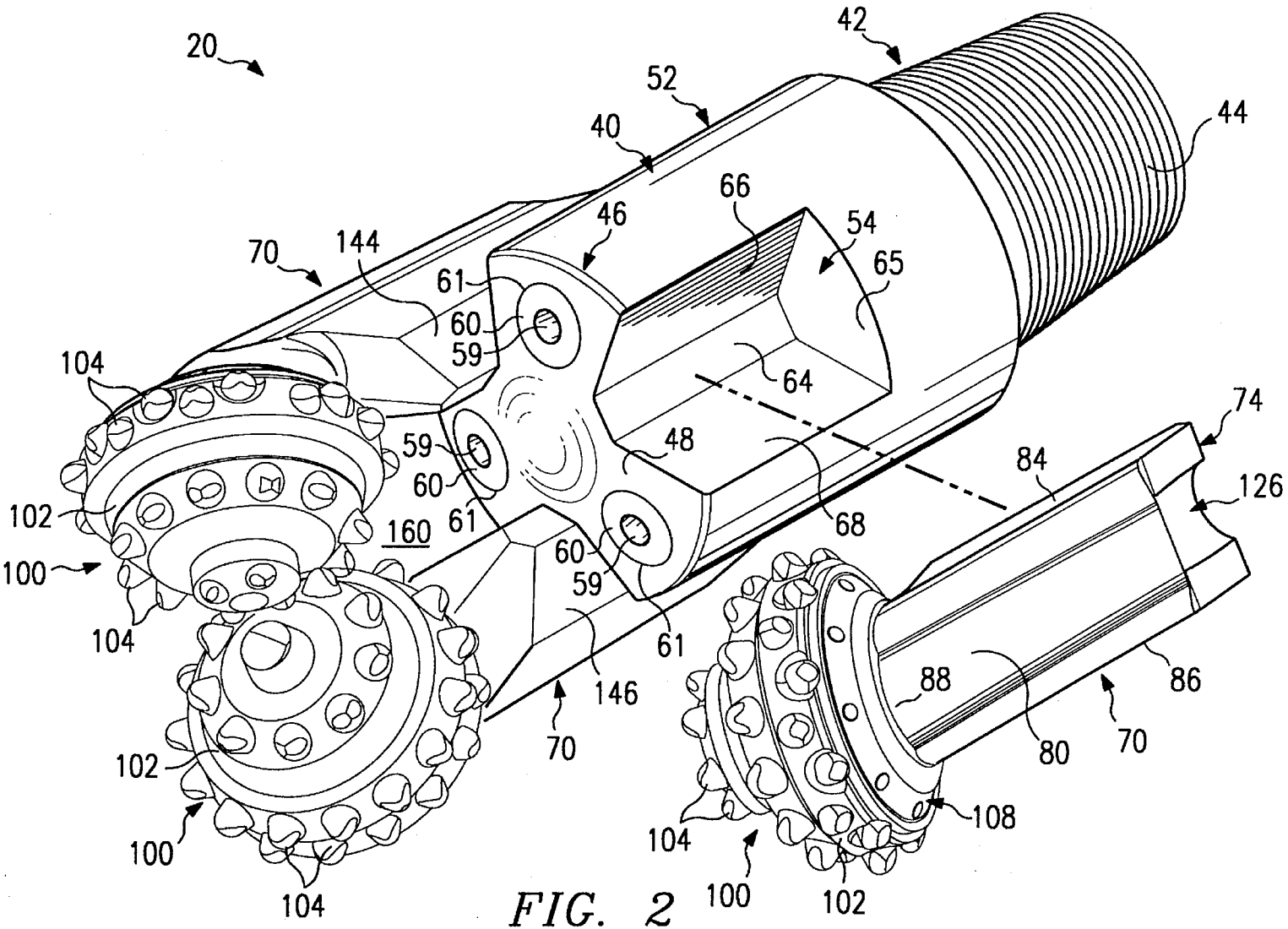
FIG. 2 is an isometric drawing showing a partially exploded view of a rotary cone drill bit having support arms incorporating an embodiment of the present invention.
Figure 3:
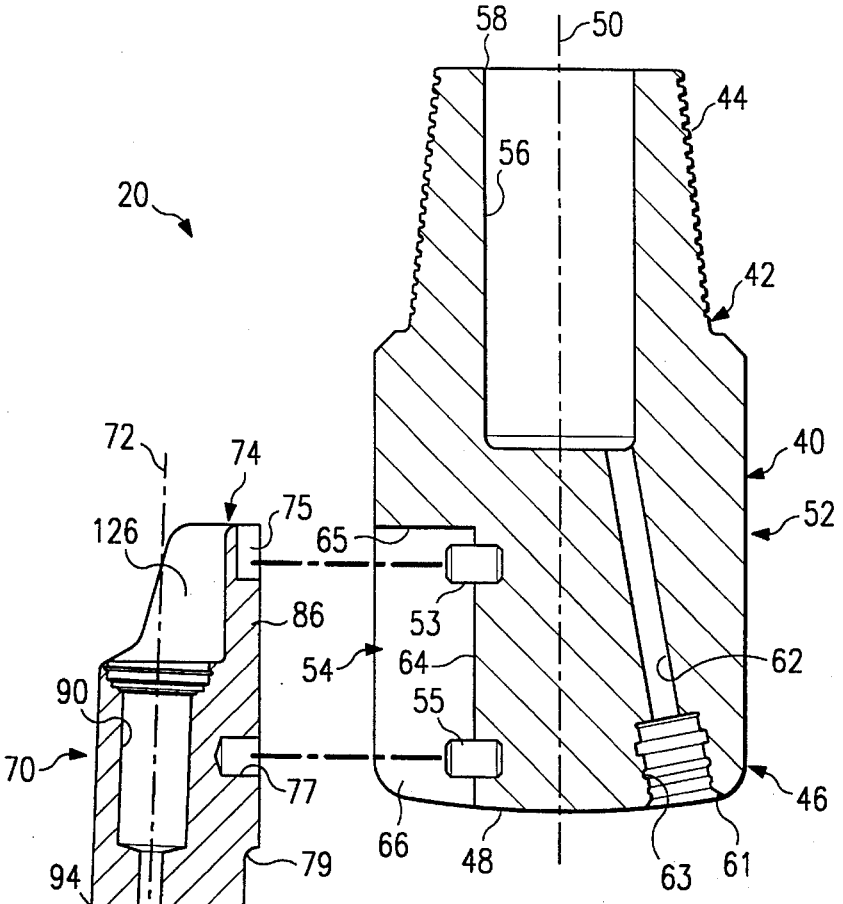
FIG. 3 is an exploded drawing partially in section showing portions of a one-piece bit body, support arm, and cutter cone assembly incorporating an embodiment of the present invention.

As shown in FIGS. 1, 2, and 3 each cutter cone assembly 100 includes cutting edges 102 and protruding inserts 104 which scrape and gouge against the sides and bottom of borehole 24 in response to weight and rotation applied to drill bit 20 from drill string 22. The position of cutting edges 102 and inserts 104 for each cutter cone assembly 100 may be varied to provide the desired downhole cutting action. Other types of cutter cone assemblies may be satisfactory used with the present invention including, but not limited to, cutter cone assemblies having milled teeth instead of inserts 104. Cuttings and other debris created by drill bit 20 may be carried from the bottom of borehole 24 to the well surface by drilling fluids exiting from nozzles 60. The debris carrying fluid generally flows radially outward from beneath drill bit 20 and then flows upward towards the well surface through annulus 26.

Drill bit 20 preferably comprises a one-piece or unitary bit body 40 with upper portion 42 having threaded connection or pin 44 adapted to secure drill bit 20 with the lower end of drill string 22. Three support arms 70 are preferably attached to and extend longitudinally from bit body 40 opposite from pin 44. Each support arm 70 preferably includes spindle 82 connected to and extending from inside surface 76 of the respective support arm 70.

Bit body 40 includes lower portion 46 having a generally convex exterior surface 48 formed thereon. The dimensions of convex surface 48 and the location of cutter cone assemblies 100 are selected to optimize fluid flow between lower portion 46 of bit body 40 and cutter cone assemblies 100. The location of cutter cone assemblies 100 relative to lower portion 46 may be varied by adjusting the length of the associated support arm 70 and the spacing of each support arm 70 on the exterior of bit body 40.

FIG. 3 is an exploded drawing which shows the relationship between bit body 40, one of the support arms 70 and its associated cutter cone assembly 100. Bit body 40 includes middle portion 52 disposed between upper portion 42 and lower portion 46. Longitudinal axis or central axis 50 extends through bit body 40 and corresponds generally with the projected axis of rotation for drill bit 20. Middle portion 52 preferably has a generally cylindrical configuration with pockets 54 formed in the exterior thereof and spaced radially from each other. The number of pockets 54 is selected to correspond with the number of support arms 70 which will be attached thereto. The spacing of pockets 54 with respect to each other in the exterior of middle portion 52 is selected to correspond with the desired spacing of support arms 70 and their associated cutter cone assemblies 100 with respect to longitudinal axis 50 and the projected axis of rotation for drill bit 20.

Each support arm 70 has a longitudinal axis 72 extending therethrough. Support arms 70 are preferably mounted in their respective pockets 54 with their respective longitudinal axis 72 aligned substantially parallel with each other and with longitudinal axis 50 of the associated bit body 40. For one application a portion of each support arm 70 is preferably welded within its associated pocket by a series of welds (not shown) formed between the exterior or perimeter of each pocket 54 and adjacent portions of the associated support arm 70.

Each cutter cone assembly 100 is preferably constructed and mounted on its associated spindle 82 in a substantially identical manner. Each support arm 70 is preferably constructed and mounted in its associated pocket 54 in substantially the same manner. Therefore, only one support arm 70 and cutter cone assembly 100 will be described in detail since the same description applies generally to the other two support arms 70 and their associated cutter cone assemblies 100.

Support arm 70 has a generally rectangular configuration with respect longitudinal axis 72. Support arm 70 may have various cross-sections taken normal to longitudinal axis 72, depending upon the configuration of the associated pocket 54 and other features which may be incorporated into support arm 70 in accordance with the teachings of the present invention. Support arm 70 includes top surface 74, inside surface 76, bottom edge 78 and exterior surface 80. Support arm 70 also includes sides 84 and 86 which preferably extend parallel to each other and longitudinal axis 72. The dimensions and configuration of each support arm 70 are selected to be compatible with the associated pocket 54. As shown in FIGS. 2 and 3, a portion of each support arm 70, including upper end or top surface 74 and adjacent portions of inside surface 76 and sides 84 and 86, is sized to fit within the associated pocket 54.

As will be explained later in more detail, inside surface 76 may be modified as desired to provide various features of the present invention. Inside surface 76 may include center portion 142 with angled surfaces 144 and 146 formed adjacent thereto. The configuration of inside surface 76 may be varied substantially between top surface 74 and bottom edge 78. Inside surface 76 and exterior surface 80 are contiguous at bottom edge 78 of support arm 70. The portion of exterior surface 80 formed adjacent to bottom edge 78 is often referred to as shirttail surface 88.

Spindle 82 is preferably angled downwardly and inwardly with respect to both longitudinal axis 72 of support arm 70 and the projected axis of rotation of drill bit 20. This orientation of spindle 82 results in the exterior of cutter cone assembly 100 engaging the side and bottom of borehole 24 during drilling operations. For some applications, it may be preferable to position each support arm 70 and its associated spindle 82 with cutter cone assembly 100 at an offset from the projected axis of rotation of drill bit 20. The desired offset can be easily obtained by forming the associated pockets 54 in the exterior of bit body 40 with a corresponding offset from longitudinal axis 50 of bit body 40. The amount of offset may vary from zero to five or six degrees or zero inches to one half inch in the direction of rotation of drill bit 20.

As shown in FIGS. 1, 2, and 3, each cutter cone assembly 100 preferably includes base portion 108 with a conically shaped shell or tip 106 extending therefrom. For some applications, base portion 108 includes a frustoconically shaped outer surface 110 which is preferably angled in a direction opposite from the angle of shell 106. Base 108 also includes backface 112 which may be disposed adjacent to portions of inside surface 76 of the associated support arm 70. As will be explained later in more detail, an important feature of one embodiment of the invention includes the relationship between backface 112, the adjacent portions of inside surface 76 (throat relief area 87) and shirttail 88 formed on exterior surface 80 of the associated support arm 70.

Base 108 preferably includes opening 120 with chamber 114 extending therefrom. Chamber 114 preferably extends through base 108 and into tip 106. The dimensions of opening 120 in chamber 114 are selected to allow mounting each cutter cone assembly 100 on its associated spindle 82. One or more bearing assemblies 122 are preferably mounted on spindle 82 and disposed between a bearing wall (not shown) within chamber 114 and annular bearing surface 81 on spindle 82. A conventional ball retaining system 124 may be used to secure cutter cone assembly 100 to spindle 82.

As shown in FIGS. 2 and 3, each pocket 54 includes back wall 64 and a pair of side walls 66 and 68. The dimensions of back wall 64 and side walls 66 and 68 are selected to be compatible with the adjacent inside surface 76 and sides 84 and 86 of the associated support arm 70. By limiting the width of support arms 70, sufficient void space 160 is provided between adjacent support arms 70 to allow for enhanced fluid flow between support arms 70 and convex surface 48 on lower portion 46 of bit body 40.

An important feature of the present invention includes the ability to vary the length of support arm 70 to provide the desired fluid flow between the associated cutter cone assembly 70 mounted on each support arm 70 and the lower end convex surface 48 on lower portion 46 of bit body 40. For one application, the length of support arm 70 from top surface 74 to bottom edge 78 is preferably selected to be at least three times the width of support arm 70.

As shown in FIGS. 1, 2 and 3, a portion of top surface 74, exterior surface 80 and adjacent sides 84 and 86 have been removed from the upper portion of support arm 70 to provide cavity 90 for installing a lubricant reservoir (not shown) therein. Cutter cone assembly 100 may be retained on its associated spindle 82 by inserting a plurality of ball bearings 124 through ball passageway 96 extending from exterior surface 80 of support arm 70 through spindle 82 and ball race 98 in spindle 82. A matching ball race will typically be provided on the interior of cutter cone assembly 100. Once inserted, ball bearings 124 in cooperation with the ball races will prevent disengagement of cutter cone assembly 100 from spindle 82. Ball passage 96 may be subsequently plugged by welding or other well known techniques. For some applications, a ball plug (not shown) may also be placed in passageway 96.

Figure 4:
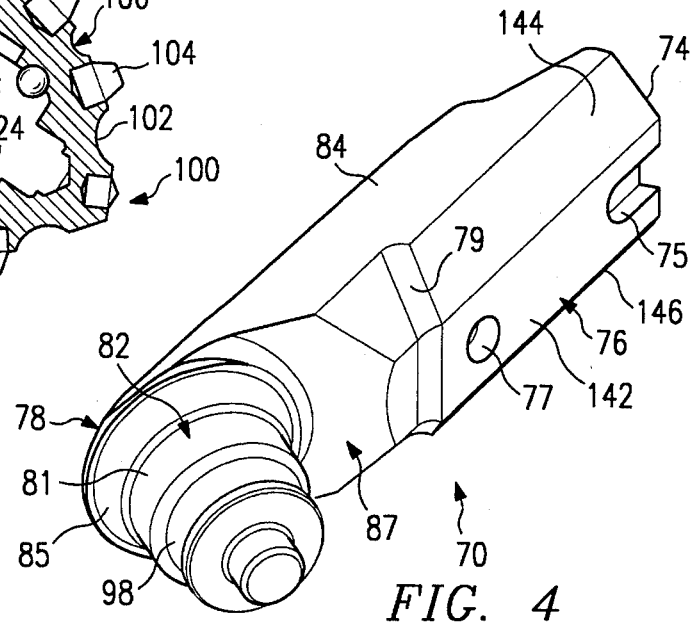
FIG. 4 is an isometric drawing of a support arm incorporating an embodiment of the present invention.

For one embodiment of the present invention as shown in FIGS. 4 and 5, first opening 75 and second opening 77 are formed in inside surface 76 of each support arm 70. First post 53 and second post 55 are preferably formed on back wall 64 of each pocket 54. Posts 53 and 54 extend radially from each back wall 64 to cooperate respectively with first opening 75 and second opening 77 to position each support arm 70 within its associated pocket 54. For one embodiment of the present invention first opening 75 preferably comprises a longitudinal slot extending from top surface 74 and sized to receive first post 53 therein. Second opening 77 preferably has a generally circular configuration sized to receive second post 55 therein. First opening 75 is preferably formed as a longitudinal slot to compensate for any variation between the dimensions of support arm 70 and its associated pocket 54 including the relative position of first opening 75, second opening 77 and the respective first post 53 and second post 55.

As shown in FIGS. 4 and 5, inside surface 76 of support arm 70 preferably includes center portion 142 with angled surfaces 144 and 146 extending longitudinally and parallel with each other from top surface 74 to throat relief area 87 formed on the lower portion of inside surface 76. For one application, welding groove 79 may be formed on inside surface 76 to assist in welding support arm 70 with adjacent portions of the associated pocket 54. Forming welding groove 79 in inside surface 76 creates a break across angled surface 144 center portion 142 and angled surface 146. In FIG. 5 the upper portion of angled surface of 144 is designated as **144*a* and the lower portion is designated as 144*b*. Center portion 142 is also designated as 142*a* and 142*b*. As will be explained later in more detail, exterior surface 80 may include a pair of tapered surfaces 191 and 291**.

Rotary cone drill bit 220 incorporating another embodiment of the present invention is shown in FIG. 6. Bit body 240 may be formed by welding three segments with each other to form integrated bit body 240 having support arms 270 extending therefrom. Threaded connection 44 may be formed on upper portion 242 of bit body 240 for use in attaching drill bit 220 to drill string 22. The lower portion of each support arm 270 is preferably formed with the same configuration and features as support arms 70 of drill bit 20.

For rotary cone drill bit 220, cutting action or drilling action occurs as cutter cone assemblies 100 are rolled around the bottom of borehole 24. Each cutter cone assembly 100 will scrape and gouge against the sides and bottom of borehole 24 in response to weight and rotation applied to drill bit 220. Cuttings and other debris thus created by drill bit 220 may be carried from the bottom of borehole 24 to the well surface by drilling fluids exiting from nozzles 260. The debris carrying drilling fluid generally flows radially outward from beneath lower portion 246 of bit body 240 and upwardly to the well surface through annulus 26. Bit body 240 also includes nozzle housings 263 formed on the exterior thereof for each nozzle 260. Thus, the use of bit body 240 will typically result in a smaller fluid flow area between wall 28 of borehole 24 for the same size drill bit as compared with one piece bit body 40.

As previously noted, bit body 240 preferably includes three support arms 270 extending therefrom. Only two support arms 270 are shown in FIG. 6. The lower portion **70*a* of each support arm 270 and its associated cutter cone assembly 100 are preferably constructed in the same manner as lower portion 70*a* of support arm 70. Accordingly, only the lower portion 70*a* of support arm 70 and its associated cutter cone assembly 100 will be described in detail with the understanding that this same description may be applied to support arms 270 and their associated cutter cone assemblies 100**.

Figure 9:
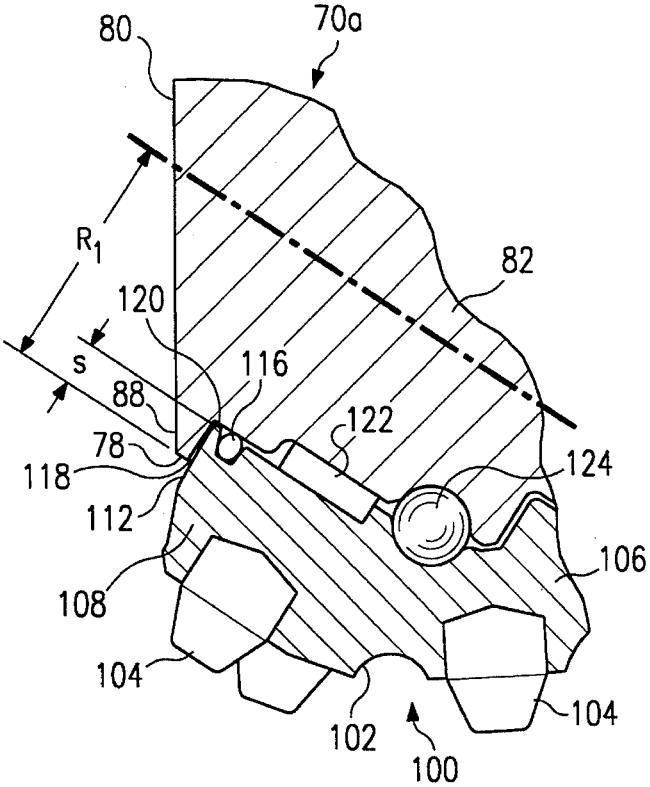
FIG. 9 is an enlarged drawing in section with portions broken away showing portions of a support arm and cutter cone assembly incorporating an embodiment of the present invention for use with either the rotary cone drill bit of FIG. 2 or FIG. 6.

The lower portion **70*a* of support arm 70 and its associated spindle 82 are shown in more detail in FIGS. 7, 8, and 9. Spindle 82 includes axis 83 extending from inside surface 76 of support arm 70. Various features of the lower portion 70*a* of support arm 70 will be described with respect to axis 83 of spindle 82**.

A generally circular flat machined surface 85 is preferably formed adjacent to the junction between inside surface 76 of support arm 70 and spindle 82. Machined area 85 may sometimes be referred to as the "last machined surface or LMS" of support arm 70. A throat relief area 87 is preferably provided on inside surface 76 adjacent to spindle 82 and extending upwardly therefrom. For one application throat relief area 87 may be formed in part by two symmetrically angled planes 187 and 287 tilted at an angle of approximately 15° below what would be the normal continuation from machined surface 85 to inside surface 76 of support arm 70. Machined surface 85 and throat relief area 87 cooperate with each other to form a boss around the associated spindle 82 which results in elevating backface 112 of the associated cutter cone assembly 100 from the adjacent inside surface 76. Dotted line 112 shown in FIG. 8 corresponds to the outside diameter of backface 112.

Planes 187 and 287 are preferably joined with each other along an extension from longitudinal axis 72 of support arm 70. Planes 187 and 287 preferably each include respective curved radius portions 185 and 285 which conform to the associated machined surface 85 to create the desired throat relief area 87. For one application, throat relief area 87 and its associated planes 187 and 287 are preferably contiguous with at least one-half the circumference or approximately one hundred eighty degrees (180°) of the outside diameter of machined surface 85 extending from leading edge 289 to trailing edge 189 of support arm 70. A flow path is thus formed between backface 112 of cutter cone assembly 100 and throat relief area 87 of the associated support arm 70 which allows fluid to pass therethrough and to keep lower portion 70*a* and cutter cone assembly 100 free from the buildup of cuttings and other downhole debris. For some applications, support arm 70 may be formed from a forging (not shown) which includes a relief area having a convex surface corresponding approximately to throat relief area 87.

Throat relief area 87 substantially reduces and/or eliminates wear normally caused by abrasive particles and fluids flowing between backface 112 of the associated cutter cone assembly 100 and lower portion 70*a* of its associated support arm 70 or 270. These fine abrasive particles tend to wear away portions such as shirttail 88 of the associated support arm 70 or 270 as cutter cone assembly 100 turns during drilling operations. When this wear occurs, the sealing surfaces between support arm 70 or 270 and its associated cutter cone assembly 100 may be exposed such that the associated elastomeric seal 116 may fail.

Machined surface 85 preferably has a generally circular configuration defined by radius $R_1$ as shown in FIGS. 8 and 9 extending from axis 83 of spindle 82 which results in machined surface 85 extending uniformly through three hundred sixty degrees around axis 83 of spindle 82. Machined surface 85 and its associated radius $R_1$ cooperate with exterior surface 80 to partially define shirttail surface 88 and bottom edge 78 of support arm 70 or 270.

By maintaining the same radius $R_1$ completely around axis 83 of spindle 82, the width of at least lower portion 70*a* of support arm 70 or 270 is preferably equal to twice the radius $R_1$. For some applications, this width may be maintained for the full length of support arm 70 including the portion of support arm 70 which is attached with the associated pocket 54.

By limiting the width of lower portion 70*a* to approximately twice the radius $R_1$, ears or projections typically associated with conventional support arms and drill bits have been eliminated. Such ears or projections generally extend beyond the backface of the associated cutter cone assembly and create a wedging effect for cuttings and other downhole debris to lodge between the ears on the leading edge of the support arm and the backface of the associated cutter cone assembly. These wedges or packed cuttings may then be forced into the sealing area creating additional seal wear during downhole rotation of the associated drill bit. The open area formed between backface 112 and throat relief area 87 allows increased fluid flow to aid in keeping the unwanted abrasive particles away from the sensitive sealing areas of cutter cone assembly 100 and spindle 82.

As shown in FIG. 9 cutter cone assembly 100 is preferably positioned on the associated spindle 82 with a gap 118 formed between backface 112 and the adjacent portion of support arm 70. An appropriately sized elastomeric seal 116 is preferably disposed within chamber 114 adjacent to sealing surface 120 on the exterior of spindle 82. Seal 116 protects against the infiltration of drilling fluids, cutting and downhole debris through gap 118 to the space between the relatively rotating bearing surfaces of spindle 82 and cutter cone assembly 100. Such infiltration will eventually result in damage to the bearing assemblies disposed between cutter cone assembly 100 and spindle 82.

Figure 11:
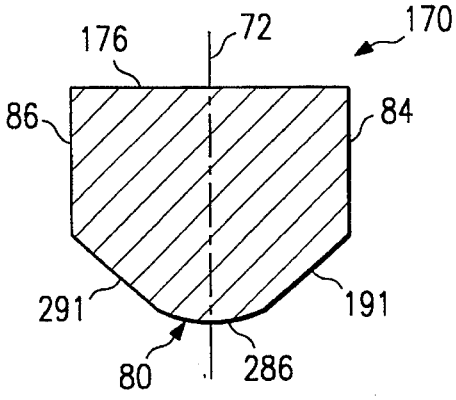
FIG. 11 is a drawing in section taken along line 11—11 of FIG. 10.
Figure 12:
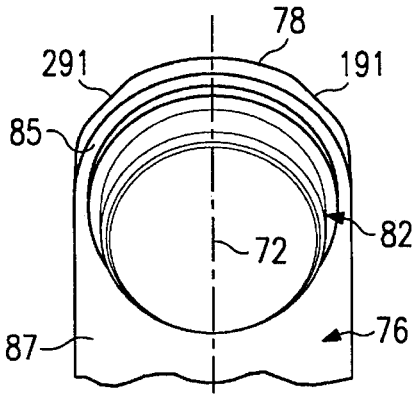
FIG. 12 is an end view with portions broken away of the support arm shown in FIG. 10.
Figure 10:
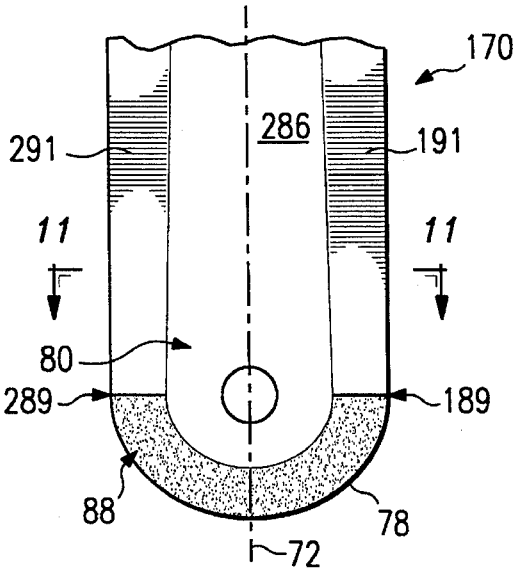
FIG. 10 is a drawing in elevation with portions broaden away showing the exterior surface of a support arm incorporating another embodiment of the present invention.

An alternative embodiment of the present invention is represented by support arm 170 as shown in FIGS. 10, 11 and 12. The features of support arm 170 are similar to previously described support arm 70, except for inside surface 176 as compared to inside surface 76. Support arm 170 preferably has a generally rectangular configuration normal to longitudinal axis 72.

An important feature of the present invention includes providing shirttail surface 88 on exterior 80 of both support arms 70 and 170 adjacent to bottom edge 78. The width of the lower portion of both support arms 70 and 170 may be equal to approximately twice the radius ($R_1$) from axis 83 of the associated spindle 82 to the outside diameter of the associated machined surface 85. Bottom edge 78 and shirttail surface 88 preferably have an outside diameter corresponding generally with the outside diameter of machined surface 85. Shirttail surface 88 preferably has an inside diameter defined by a second radius ($R_2$) which corresponds generally to the radius of spindle 82 at its junction with machined surface 85. To protect against erosion, shirttail surface 88 may be covered with a layer of conventional hard facing material. Such hard facing materials typically include tungsten carbide particles disbursed within a cobalt, nickel, or iron-based alloy mix and may be applied using well-known fusion welding processes or other suitable techniques.

For one application such as shown in FIGS. 10, 11, and 12 tapered surfaces 191 and 291 may be formed as part of exterior surface 80 on opposite sides of longitudinal axis 72. Tapered surfaces 191 and 291 cooperate with each other to provide enhanced fluid flow between exterior surface 80 and wall 28 of borehole 24. Tapered surface 291 cooperates with shirttail surface 88 to provide a leading edge 289 which is protected from impingement with cuttings and other downhole debris during operation of the associated drill bit 20 or 220. Tapering a portion of shirttail surface 88 on the leading edge 289 of support arm 70 and 170 promotes increased fluid flow to remove cuttings and other downhole debris between the exterior of support arm 70 and 170 and wall 28 of borehole 24.

The portion of exterior surface 80 formed between tapered surfaces 191 and 291 is designated as 286. For one application portion 285 of exterior surface 80 includes a radius of curvature which is approximately one-half the radius of curvature associated with wall 28 of borehole 24. By providing portion 286 with a radius of curvature substantially less than the radius of curvature associated with wall 28 of borehole 24, the associated support arms 70 and 270 will tend to move away from wall 28. Thus additional fluid flow area will be provided between exterior surface 80 and wall 28. Tapered surfaces 191 and 291 cooperate with portion 286 to provide enhanced fluid flow between exterior surface 80 and wall 28 of borehole 24.

Figure 13:
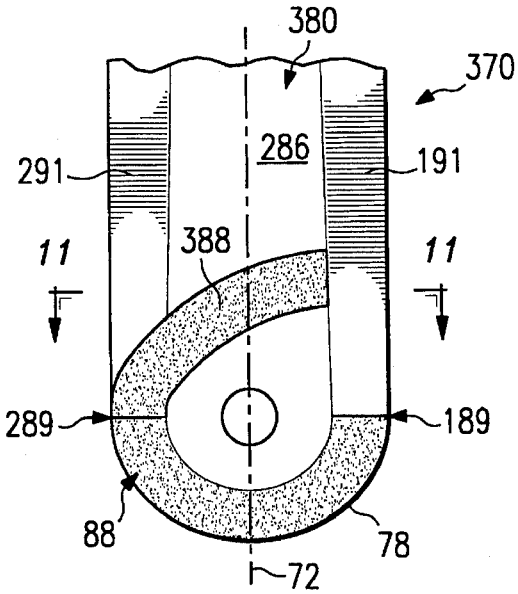
FIG. 13 is a drawing in elevation with portions broken away showing the exterior surface of a support arm incorporating a further embodiment of the present invention.

The lower portion of support arm 370 shown in FIG. 13 illustrates a further embodiment of the present invention. Exterior surface 380 of support arm 370 is substantially the same as previously described with respect to exterior surface 80 of support arm 170. Shirttail extension 388 represents the principal difference between exterior surface 380 and exterior surface 80. Shirttail extension 380 preferably extends from leading edge 289 across tapered surface 291 and radius portion 285. Shirttail extension 388 may be covered with a layer of hard facing material such as tungsten carbide particles dispersed within a cobalt, nickel or iron based alloy mix and may be applied using well-known fusion welding processes or other suitable techniques as previously described with respect to shirttail 88. Shirttail extension 388 further protects exterior surface 380 of support arm 370 from erosion.

The various features associated with lower portion 70*a* of support arm 70 and/or exterior surfaces 80 and 380 of support arms 70, 170, and 370 may be combined with each other as desired to provide enhanced fluid flow and to minimize erosion with respect to machined surfaces associated with cutter cone assembly 100 and support arms 70, 170, and 370. The service life of seal 116 and bearing assemblies within chamber 114 are thus lengthened.

Although the present invention and its advantages have been described in detail, it should be understood that various changes, substitutions and alterations can be made therein without departing from the spirit and scope of the invention as defined by the appended claims.

What is claimed is:

1. A rotary cone drill bit for forming a borehole, comprising:

a bit body having a lower exterior surface, and an upper end portion adapted for connection to a drill string for rotation of said bit body;

a number of support arms extending from said bit body, each of said support arms having a lower portion with an inside surface and a machined surface formed thereon;

a spindle connected to each of said machined surfaces with each spindle projecting generally downwardly and inwardly with respect to its associated support arm;

a number of cutter cone assemblies equaling said number of support arms and mounted respectively on one of said spindles;

said inside surface of each support arm having a throat relief area formed adjacent to said spindle and extending contiguous with adjacent portions of said machined surface whereby said throat relief area and said cutter cone assembly mounted on said spindle cooperate with each other to provide enhanced fluid flow between said cutter cone assembly and said throat relief area;

said machined surface having a generally uniform outside diameter formed on said inside surface adjacent to said spindle;

said spindle having an axis extending therethrough and said outside diameter of said machine surface having a radius $R_1$ extending from said spindle axis;

said lower portion of said support arm having a width equal to approximately twice the value of $R_1$; and said throat relief area extending contiguous from said machined surface over approximately 180° of said outside diameter.

2. The drill bit as defined by claim 1 wherein each of said cutter cone assemblies further comprises:

a generally conical cutter body having a base and a tip pointed away from said base;

an opening formed in said base with a chamber extending from said opening through said base and into said tip; and an outer portion of said base having a generally frustoconical shape directed away from said tip and a backface surrounding said opening for said chamber whereby said backface and said throat relief area cooperate with each other to provide enhanced fluid flow between said cutter cone assembly and said adjacent inside surface of its associated support arm.

3. The drill bit as defined by claim 1 wherein each of said support arms further comprises:

said lower portion of said support arm having an exterior surface; and a shirttail surface formed as part of said exterior surface of said support arm with said shirttail surface having a radius approximately equal to $R_1$.

4. The drill bit as defined by claim 3 wherein each of said support arms further comprise a bottom edge defined in part by a radius approximately equal to $R_1$ extending from said spindle axis.

5. The drill bit as defined by claim 4 wherein each support arm further comprises:

said shirttail surface formed on said exterior surface adjacent to and extending from said bottom edge; and said shirttail surface defined in part by a second radius extending from said spindle axis wherein said second radius is equal to the radius of said spindle with said shirttail surface defined in part by said bottom edge of said second radius.

6. The drill bit as defined by claim 1 further comprising:

said bit body having a number of pockets formed on the exterior of said bit body and said number of pockets equal to said number of support arms;

each of said support arms attached to one of said pockets on the exterior of said bit body; and each of said support arms having an axis extending longitudinally therethrough and aligned substantially parallel with said respective longitudinal axis of said other support arms.

7. The drill bit as defined by claim 1 further comprising three segments welded with each other to integrally form said bit body and said support arms extending therefrom.

8. A support arm and cutter cone assembly for a rotary drill bit having a bit body comprising:

said support arm having a lower portion with an inside surface, an exterior surface, a shirttail surface formed as part of said exterior surface and a bottom edge;

said inside surface and said shirttail surface formed contiguous with each other at said bottom edge;

a spindle attach to said inside surface near said bottom edge and angled downwardly and inwardly with respect to said support arm;

said cutter cone assembly having an opening with a chamber formed therein for mounting said cutter cone assembly on said spindle;

said inside surface of said support arm having a throat relief area formed adjacent to said spindle whereby said throat relief area and said cutter cone assembly mounted on said spindle cooperate with each other to provide enhanced fluid flow between said cutter cone assembly and said throat relief area;

a machined surface having an outside diameter formed on said inside surface adjacent to said spindle;

said spindle having an axis extending therethrough and said outside diameter of said machined surface having a radius $R_1$ from said spindle axis;

said lower portion of said support arm having a generally uniform width equal to approximately twice the value of $R_1$; and said throat relief area extending contiguous from said machined surface over approximately 180° of said outside diameter.

9. The support arm and cutter cone assembly of claim 8 wherein said support arm further comprises said lower portion having a generally rectangular cross-section with said width of said lower portion equal to approximately twice the value of $R_1$.

10. The support arm and cutter cone assembly of claim 8 wherein said bottom edge is defined in part by a radius approximately equal to $R_1$ extending from said spindle axis and said shirttail surface extends continuously adjacent to said bottom edge.

11. The support arm and cutter cone assembly of claim 8 wherein said support arm further comprises:

an axis extending longitudinally through said support arm;

a pair of tapered surfaces disposed longitudinally on said exterior of said support arm opposite from each other; and said tapered surfaces extending substantially parallel with each other and with said longitudinal axis of said support arm.

12. The support arm and cutter cone assembly of claim 11 wherein said tapered surfaces intersect with said shirttail surface near said bottom edge of said support arm.

13. The support arm and cutter cone assembly of claim 8 wherein said cutter cone assembly further comprises:

a generally conical cutter body having a base portion and a tip portion extending therefrom with said opening formed in said base portion;

said cavity extending from said opening in said base portion partially through said tip; and a backface formed on said base portion surrounding said opening whereby said backface and said throat relief area cooperate with each other to provide enhanced fluid flow between said cutter cone assembly and said adjacent inside surface of said support arm.

14. A support arm and cutter cone assembly for a rotary drill bit having a bit body comprising:

said support arm having a lower portion with an inside surface, an exterior surface, a shirttail surface formed as part of said exterior surface and a bottom edge;

said inside surface and said shirttail surface formed contiguous with each other at said bottom edge;

a spindle attached to said inside surface near said bottom edge and angled downwardly and inwardly with respect to said support arm;

said cutter cone assembly having an opening with a chamber formed therein for mounting said cutter cone assembly on said spindle;

said inside surface of said support arm having a throat relief area formed adjacent to said spindle whereby said throat relief area and said cutter cone assembly mounted on said spindle cooperate with each other to provide enhanced fluid flow between said cutter cone assembly and said throat relief area; and said throat relief area further comprises a pair of tapered surfaces extending upwardly from said spindle and intersecting with each other along a line projecting from a longitudinal axis of said support arm.

15. A support arm and cutter cone assembly for a rotary drill bit having a bit body comprising:

said support arm having a lower portion with an inside surface, and exterior surface, a shirttail surface formed as part of said exterior surface and a bottom edge;

said inside surface and said shirttail surface formed contiguous with each other at said bottom edge;

a spindle attached to said inside surface near said bottom edge and angled downwardly and inwardly with respect to said support arm;

said cutter cone assembly having an opening with a chamber formed therein for mounting said cutter cone assembly on said spindle;

said lower portion of said support arm having a longitudinal axis extending therethrough;

a pair of tapered surfaces disposed longitudinally on said exterior surface opposite from each other and approximately parallel with said longitudinal axis;

said inside surface of said support arm comprising a throat relief area formed adjacent to said spindle whereby said throat relief area and said cutter cone assembly mounted on said spindle cooperate with each other to provide enhanced fluid flow between said cutter cone assembly and said throat relief area; and said throat relief area further comprises a pair of tapered surfaces extending upwardly from said spindle and intersecting along a line projecting from said longitudinal axis of said support arm.

16. The support arm and cutter cone assembly of claim 15 wherein said pair of tapered surfaces further comprises:

a first tapered surface extending upwardly from said machined surface;

a second tapered surface extending upwardly from said machined surface; and said first tapered surface joined with said second tapered surface along a projection from said longitudinal axis of said support arm.

17. The support arm and cutter cone assembly of claim 16 wherein said throat relief area further comprises said first tapered surface and said second tapered surface form contiguous with approximately one-half of the outside diameter of said machined surface.

18. The support arm and cutter cone assembly of claim 15 wherein said spindle is sized to accommodate more than one cutter cone assembly.

19. The support arm and cutter cone assembly of claim 15 wherein said exterior surface further comprises;

a center portion having a radius of curvature disposed between said pair of tapered surfaces; and said radius of curvature for said center portion equal to approximately one half the radius of a borehole formed by said drill bit.

* * * * *